US008604393B2

(12) United States Patent
Odriozola

(10) Patent No.: US 8,604,393 B2
(45) **Date of Patent: *Dec. 10, 2013**

(54) CONTROL PANEL FOR A COOKING DEVICE

(71) Applicant: Coprecitec, S.L., Aretxabaleta Gipuzkoa (ES)

(72) Inventor: José Ignacio Múgica Odriozola, Bergara (ES)

(73) Assignee: Coprecitec, S.L., Aretxabaleta (ES)

( * ) Notice: Subject to any disclaimer, the term of this patent is extended or adjusted under 35 U.S.C. 154(b) by 0 days.

This patent is subject to a terminal disclaimer.

(21) Appl. No.: 13/902,524

(22) Filed: May 24, 2013

(65) Prior Publication Data

US 2013/0284716 A1 Oct. 31, 2013

Related U.S. Application Data

(63) Continuation of application No. 12/705,457, filed on Feb. 12, 2010, now Pat. No. 8,455,799.

(30) Foreign Application Priority Data

Feb. 13, 2009 (ES) ..... 200900398

(51) Int. Cl.
*H05B 3/68* (2006.01)

(52) U.S. Cl.
USPC ..... 219/445.1; 219/448.11; 219/452.11; 219/460.1

(58) Field of Classification Search
USPC ..... 219/445.1, 448.11, 452.11, 460.1
See application file for complete search history.

(56) References Cited

U.S. PATENT DOCUMENTS

| | | | |
|---|---|---|---|
| 3,886,539 | A | 5/1975 | Gould, Jr. |
| 5,958,272 | A | 9/1999 | Taplan et al. |
| 6,236,024 | B1 | 5/2001 | Gotz et al. |
| 6,376,809 | B1 | 4/2002 | Huber et al. |
| 6,664,489 | B2 | 12/2003 | Kleinhans et al. |
| 2003/0183617 | A1 | 10/2003 | Platt |

(Continued)

FOREIGN PATENT DOCUMENTS

| | | | |
|---|---|---|---|
| DE | 3010714 | A1 | 9/1981 |
| DE | 9419782.2 | U1 | 2/1995 |

(Continued)

OTHER PUBLICATIONS

Report on the State of the Art for National Patent Application No. 200900398 issued by the Spanish Office of Patents and Trademarks, dated Jun. 6, 2011, pp. 1-6.

(Continued)

*Primary Examiner* — Alexander Ghyka
(74) *Attorney, Agent, or Firm* — Tim L. Kitchen; Peter B. Scull; Hamilton, DeSanctis & Cha LLP

(57) ABSTRACT

A control panel for controlling the operation of hotplates situated on a cooking appliance. The control panel has a translucent plate that permits the location of operating elements to be visually displayed on a top surface thereof only when lighting elements associated with the operating elements are energized. The lighting elements are selectively energized and/or de-energized so that only the operating elements of a particular hotplate are visible on the top surface of the translucent plate while a user is in the process of selecting or otherwise altering an operating parameter of the particular hot plate.

12 Claims, 3 Drawing Sheets

(56) References Cited

U.S. PATENT DOCUMENTS

| | | | |
|---|---|---|---|
| 2005/0061958 | A1 | 3/2005 | Baier |
| 2007/0262072 | A1 | 11/2007 | Schilling |
| 2008/0110875 | A1 | 5/2008 | Fisher |

FOREIGN PATENT DOCUMENTS

| | | | |
|---|---|---|---|
| EP | 1050194 | B1 | 1/1999 |
| EP | 1569057 | A2 | 2/2005 |
| ES | 2198892 | | 11/2000 |
| ES | 2270905 | | 10/2001 |
| ES | 2248424 | | 8/2002 |
| ES | 2246000 | | 11/2002 |
| ES | 2307680 | | 11/2002 |
| FR | 2722602 | | 1/1996 |
| GB | 2202044 | A | 9/1988 |
| WO | 9938360 | | 7/1999 |

OTHER PUBLICATIONS

English translations of the Report on the State of the Art for National Patent Application No. 200900398 issued by the Spanish Office of Patents and Trademarks, dated Jun. 6, 2011, pp. 1-6.

CONTROL PANEL FOR A COOKING DEVICE

CROSS-REFERENCE TO RELATED APPLICATIONS

This application claims priority to Spanish Patent Application No. P200900398, filed Feb. 13, 2009.

TECHNICAL FIELD

The invention relates to cooking tops, and in particular to control panels for cooking tops.

BACKGROUND

There are known cooking tops comprising lighting elements that are located beneath a plate.

European Patent Application No. EP1569057A2 discloses a control panel for domestic appliances having buttons that are highlighted by lights to assist the user. The buttons are visible at all times although they are not always illuminated.

European Patent No. EP1050194B1 discloses a cooking plate with lighting elements located beneath the plate. Indicator symbols are created by the use of lighting elements and masks and are not printed on the cooking plate. The operating elements, on the other hand, are permanently visible either because they are printed on the surface of the plate, or because they are built into the frame of the plate.

SUMMARY OF THE DISCLOSURE

In one implementation a control panel for a cooking top is provided that includes a translucent plate, a plurality of indicating elements where at least some of the indicating elements comprise lighting elements that are located beneath the translucent plate, the indicating elements being visible through the translucent plate when the corresponding lighting elements are energized. A plurality of operating elements are also provided where each operating element corresponds to a specific position on the control panel and the operating element is activated by a user pressing on, or otherwise touching, the respective position of each operating element.

In one implementation the operating elements are associated with indicating elements that indicate their position and at least some of the indicating elements comprise lighting elements that indicate the position of the operating elements. The lighting elements light up according to the operations that the user can perform at a given time.

In one implementation, a control panel for controlling the operation of at least a first hotplate and a second hotplate situated on a cooking appliance is provided, the control panel comprising a translucent plate having a top surface, and a plurality of operating elements with each operating element having associated lighting elements located below the top surface of the translucent plate, the location of the operating elements being identifiable on the top surface of the translucent plate only when the associated lighting elements are energized, the plurality of operating elements comprising a first hotplate selection switch, a second hotplate selection switch, and at least one control switch useable to select at least one hotplate operating parameter, the lighting elements controllable to be energized and/or de-energized so that only the operating elements associated with selecting and operating a particular hotplate are made visible on the top surface of the translucent plate while a user is in the process of selecting or otherwise altering an operating parameter of the particular hot plate.

In one implementation, a control panel for a cooking appliance having at least a first hotplate and a second hotplate is provided, the control panel comprising a translucent plate having a top surface, and a plurality of operating elements with each operating element having associated lighting elements located below the top surface of the translucent plate, the location of the operating elements being identifiable on the top surface of the translucent plate only when the associated lighting elements are energized, the plurality of operating elements comprising a first hotplate selection switch, a second hotplate selection switch, and at least one control switch useable to select at least one hotplate operating parameter, at a first moment all of the associated lighting elements being de-energized, at a second moment only the associated lighting elements of the first and second hotplate selection switches are energized to cause the location of the first and second hotplate selection switches to be identifiable on the top surface of the translucent plate, upon a user acting on the first hotplate selection switch the associated lighting elements of the second hotplate selection switch are temporarily de-energized and the associated lighting elements of the hotplate control switch or switches useable in connection with the first hotplate are energized to cause the location of such hotplate control switches to be identifiable on the top surface of the translucent plate.

In another implementation, a control panel for a cooking appliance having at least a first hotplate and a second hotplate is provided, the control panel comprising a translucent plate having a top surface, an on-off control switch operable from the top surface of the translucent plate, and a plurality of operating elements with each operating element having associated lighting elements located below the top surface of the translucent plate, the location of the operating elements being identifiable on the top surface of the translucent plate only when the associated lighting elements are energized, the plurality of operating elements comprising a first hotplate selection switch, a second hotplate selection switch, and at least one control switch useable to select at least one hotplate operating parameter, all of the associated lighting elements being de-energized when the on-off control switch has an "off" status, upon the on-off control switch initially assuming an "on" status after having had an "off" status, the associated lighting elements of the first and second hotplate selection switches are energized to cause the location of the first and second hotplate selection switches to be identifiable on the top surface of the translucent plate, upon a user acting on the first or second hotplate selection switch the associated lighting elements of the non-selected hotplate selection switch are de-energized temporarily and the associated lighting elements of the hotplate control switch or switches useable only in connection with the first hotplate are energized to cause the location of such hotplate control switch or switches to be identifiable on the top surface of the translucent plate.

An advantage of the present invention is that the control panel guides the user, showing him/her at each moment only what he/she needs and hiding the rest. As a result, in one implementation the indication field of the control panel of the cooking top does not have any indicator symbols printed on it, except for the initial on and off symbol.

These and other advantages and characteristics of the invention will be made evident according to the drawings and the detailed description thereof.

DETAILED DISCLOSURE

Figure 1:
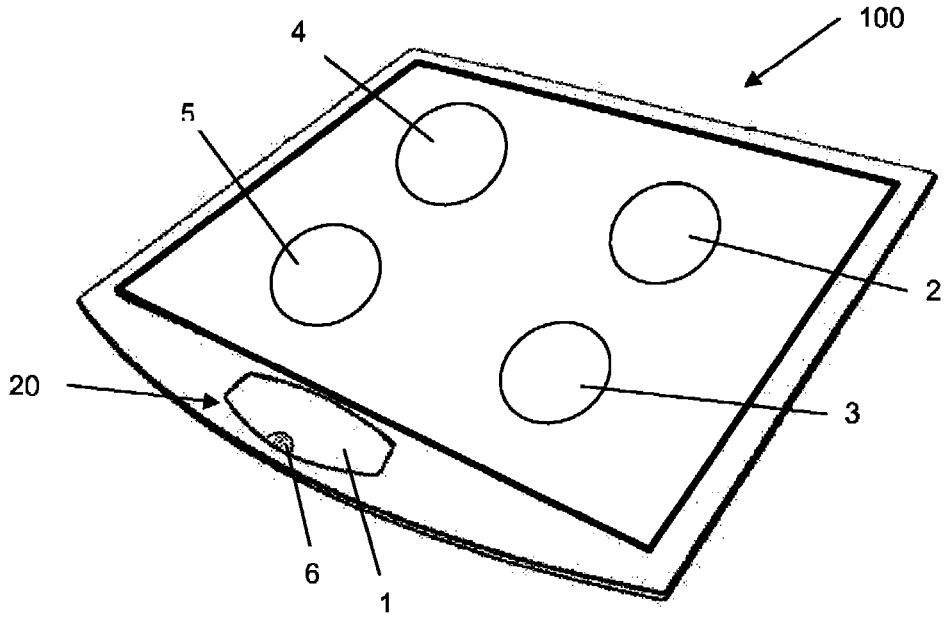
FIG. 1 shows a view in perspective of a cooking top with a control panel according to one implementation.

FIG. 1 shows a control panel 20 for a cooking top 100 in one implementation. In one implementation the cooking top 100 has a plurality of hotplates and the control panel 20 has a translucent plate 1, a plurality of indicating elements where at least some of the indicating elements comprise lighting elements that are located beneath the translucent plate, the indicating elements being visible through the cooking plate when the corresponding lighting elements are energized, and a plurality of operating elements, where each operating element corresponds to a specific position on the control panel and the operating element is activated by a user pressing, or otherwise touching, on the respective position of each operating element. In the discussion that follows, the term "pressing" is also meant to mean "touching".

In addition, the operating elements are associated with indicating elements that indicate their position, and at least some of the indicating elements comprise lighting elements that indicate the position of the operating elements. The lighting elements are illuminated according to the operations that the user is able to perform at a given time.

In the embodiment of FIG. 1, the cooking top 100 comprises four hotplates 2, 3, 4 and 5. When the cooking top 100 is switched off, all the lighting elements of the operating elements are switched off (de-energized). As a result, the operating elements are not visible except for, in one implementation, the on and off operating element 6, which is the only element that it is visible when the top 100 is switched off. Hence, advantageously, in one implementation the control panel 20 does not have any indicator symbols printed on it except for the on and off symbol 6. The cooking top 100 is switched on by pressing the on and off operating element 6. In one implementation the cooking top 100 may be switched off by pressing the on and off operating element 6 at any time.

In an alternative implementation, the control panel does not have any indicator symbols printed on it for the purpose of operating the cooking top. In such an embodiment, the on-off function is achieved by a user touching any portion of the top surface of the control panel.

Figure 2:
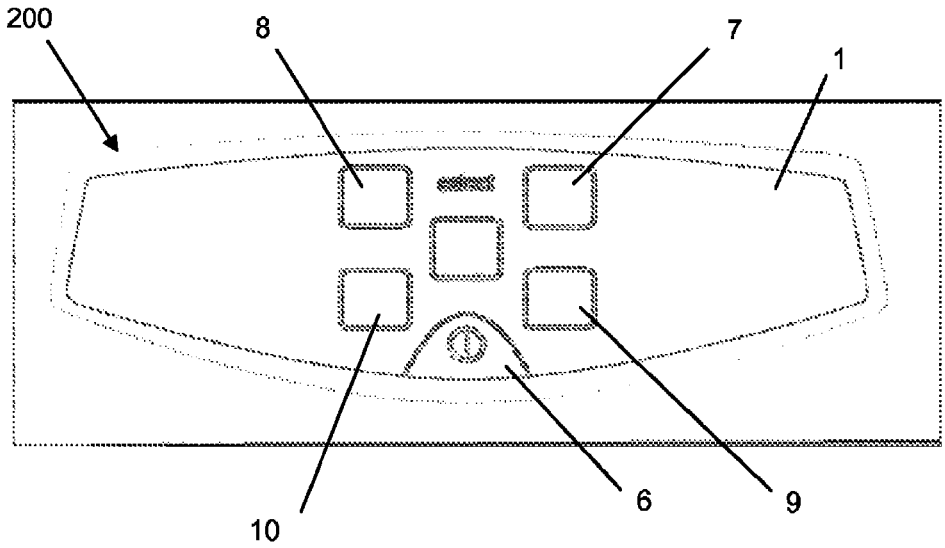
FIG. 2 shows a first view of the control panel of FIG. 1.

In one implementation when the cooking top 100 is switched off, none of the operating elements are visible on the face of the control panel except for the on and off element 6. In one implementation the on-off element 6 is always visible by way of always being illuminated when power is supplied to the control panel, or by way of a printed symbol on or within the control panel. In one implementation, when the cooking top 100 is switched on, the on-off operating element 6 is illuminated and the control panel 20 changes to a "select" mode as shown, for example, in FIG. 2. The lighting elements of the operating elements 7, 8, 9, 10 for the selection of the hotplates 2, 3, 4 and 5, which, in one implementation, comprise masks bearing hotplate-indicating symbols, are made visible on the control panel 20. Only the operating elements foreseen for use are displayed. The hotplates are switched on, or otherwise selected to be switched on, by pressing the operating element 7, 8, 9 and 10 which symbolize the corresponding hotplate 2, 3, 4 and 5, respectively.

Figure 3:
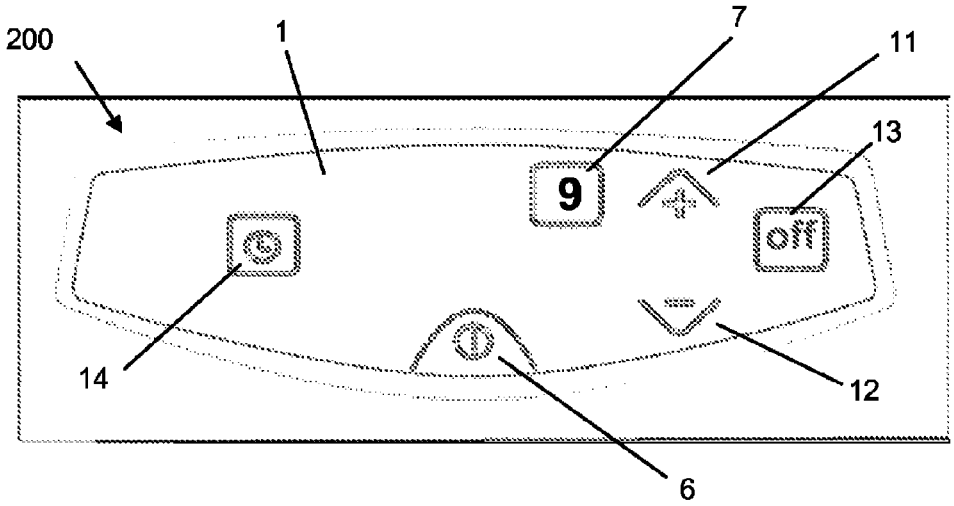
FIG. 3 shows a second view of the control panel of FIG. 1.

FIG. 3 shows an example of a control panel 20 when a hotplate has been selected. In this particular case the top-right hotplate 2 has been selected. On the control panel 20 only the operating elements that may be operated in conjunction with operating element 7 are displayed and the lighting symbols of the rest of the hotplates are switched off. In one implementation, the hotplate lighting symbols light up again after a predetermined period of time once the user has selected an operating parameter, such as a power value, of the selected hotplate 2.

When a hotplate is selected for the first time, the default power value can be, for example, the maximum value. In one implementation the maximum power value is 9 and is visible on the corresponding operating element, as shown in FIG. 3. The hotplate power value may be changed by pressing on a first power switch 11 in order to increase the power or on a second power switch 12 to decrease the power. In one implementation the first and second power switches each comprise a lighting element with a mask bearing an increase indicator symbol for the switch 11 and with a mask bearing a decrease indicator symbol for the switch 12. The increase 11 and decrease 12 indicator symbols are displayed when the user selects a specific hotplate and they are switched off after a specific period of time once the user has selected a power value for the hotplate.

Figure 6:
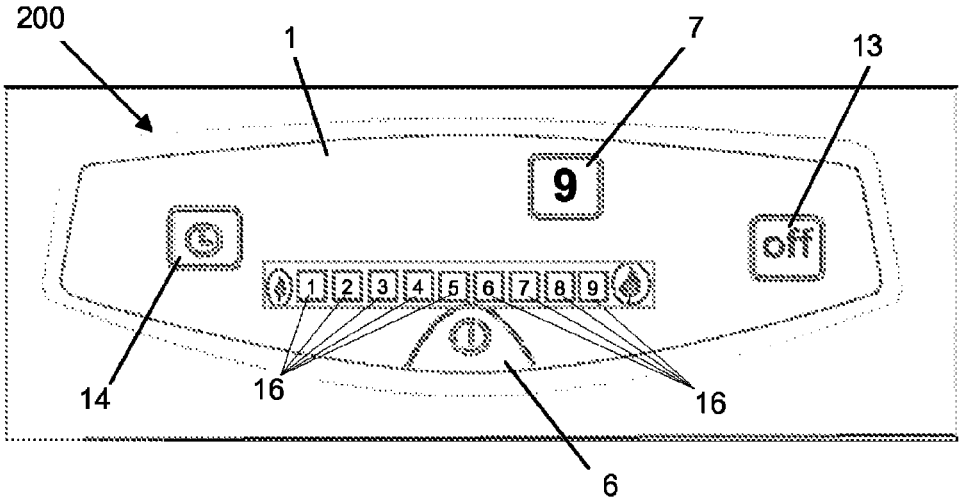
FIG. 6 shows a view of another implementation of a control panel.

FIG. 6 shows another implementation where the operating elements comprise a plurality of power switches 16, each of them associated with a specific power value. In such an implementation, each power switch 16 may comprise a lighting element that comprises a mask bearing a power value indicator symbol. As in the embodiment shown in FIG. 3, the power value indicator symbols are displayed when the user selects a specific hotplate and they are switched off after a specific period of time once the user has selected a power value for the hotplate.

Turning again to FIG. 3, in one implementation it is possible to select the cooking time for a specific hotplate. This is done by pressing a timer switch 14. In one implementation the timer switch comprises a lighting element with a mask bearing an indicator symbol showing a clock. In one implementation the timer indicator symbol lights up when the user selects a specific hotplate and subsequently switches off after a specific period of time once the user has selected a power value for the hotplate. The timer switch 14 symbol may also switch off upon the user pressing the timer switch 14 after a cooking time is selected. In another implementation, the timer switch symbol automatically switches off a predetermined amount of time after a cooking time has been selected.

Figure 4:
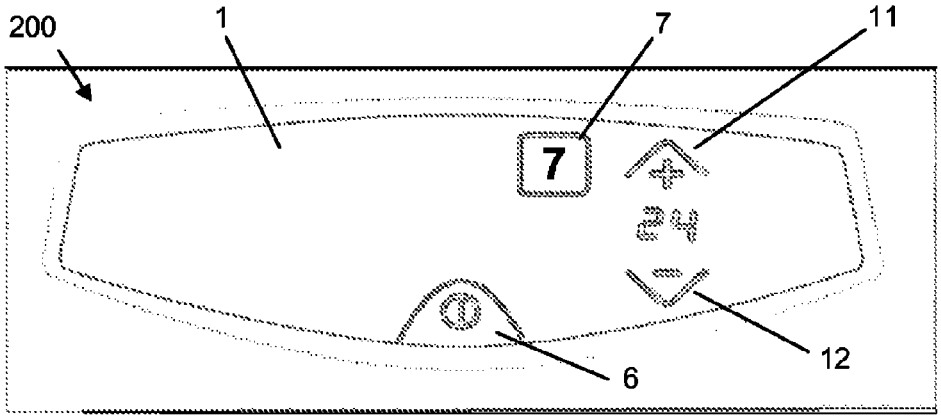
FIG. 4 shows a third view of the control panel of FIG. 1.
Figure 5:
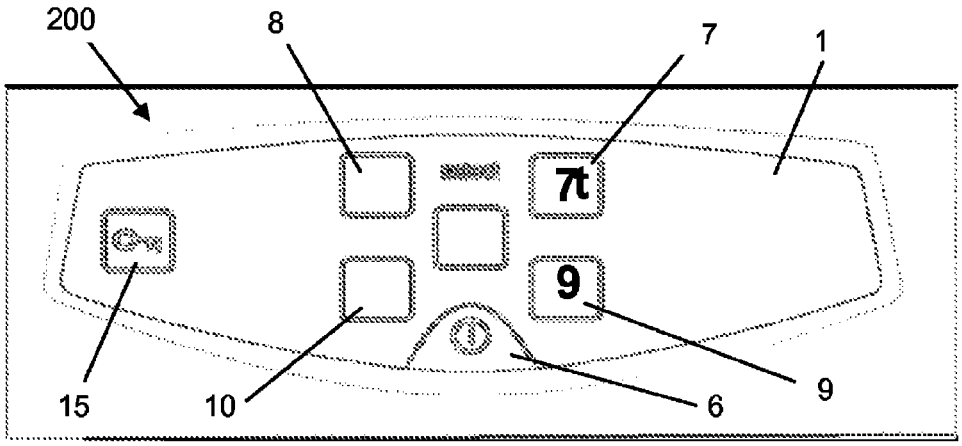
FIG. 5 shows a fourth view of the control panel of FIG. 1.

In one implementation, upon the user selecting the timer switch 14, the lighting elements of switches 11 and 12 are illuminated, as shown in FIG. 4. The user can select the cooking time with the switches. In the example of FIG. 4, the hotplate 2 will switch off automatically after 24 minutes. After a specific period of time, once the user has selected the cooking time, the switches 11 and 12 will switch off. In one implementation, the letter "t" is displayed adjacent the power value, as shown in FIG. 5. to indicate that the hotplate will switch off after the preset cooking time has elapsed. In one implementation, if a programmed hotplate is selected and the timer switch 14 is pressed again, the time remaining until the hotplate switches off is displayed.

In one implementation, a power off element 13 is presented on the face of the control panel when a hotplate has been selected, as shown, for example, in FIG. 3. Pressing the power off element 13 when a hotplate has been selected causes the selected hotplate to be turned off.

The invention contemplates the possibility of including other operating elements that make it easier, for example, to go to the previous status of the control panel 20 without confirming changes, to confirm changes, to adjust the sound of the switch when it is pressed, etc.

FIG. 5 shows a control panel 20 where the hotplate 2 has been programmed for a cooking power value 7 for a preset period of time and the hotplate 3, represented by the operating element 9, has been programmed for a cooking power value 9. In such an implementation, hotplate 3 remains on until the user switches off the hotplate or until the cooking top 100 is switched off.

In one implementation, a locking element 15 is provided on the control panel 20 as shown, for example in FIG. 5, for the purpose of locking cooking top 100 when the locking element 15 is pressed for a predetermined amount of time (e.g., a few seconds). Subsequent activation of the locking element 15 made by pressing momentarily (e.g., a few seconds) on the locking element 15 again causes the cooking top 100 to be unlocked. This option is very useful, for example, to prevent children from operating the cooking top 100.

The control panel 20 can be used for a cooking plate with a glass-ceramic cooking surface, glass-ceramic cooking being understood as a cooking system in which there is a plate of glass between the heat source and the receptacle to be heated, and which can be an electrical, induction or gas system. In a preferred embodiment, the control panel 20 is built into the cooking plate itself. The control panel 20 may also be used in a conventional gas cooking appliance.

As stated above, the control panel 20 of the cooking top 100 guides the user through the process for programming the hotplates, showing him/her at each moment only what he/she needs and hiding the rest. This prevents needless confusions in the programming process and even allows elderly people to use the cooking top 100 in a simple and intuitive way. In addition, illuminating only the operating elements that can be used at any given time, avoids the needless illumination of non-useable operating elements.

The invention claimed is:

1. A cooking appliance comprising:

a hot plate, a control panel for controlling the operation of the hotplate, the control panel comprising a translucent plate having a top surface, and a plurality of operating elements with each operating element having associated lighting elements located below the top surface of the translucent plate, the location of the operating elements being identifiable on the top surface of the translucent plate only when the associated lighting elements are energized, the plurality of operating elements comprising an on-off element having an associated lighting element that is energized to make the on-off element identifiable on the top surface of the translucent plate when power is supplied to the control panel, the plurality of operating elements also including one or more operating elements useable for altering one or more operating parameters, the associated lighting elements of the one or more operating elements controllable to be energized only when power is supplied to the control panel and the cooking appliance is switched from an "off" status to an "on" status by use of the on-off element.

2. A cooking appliance according to claim 1, wherein the one or more operating elements comprise a first operating element useable for selecting a control of a first operating parameter and a second operating element useable for selecting a control of a second operating parameter, the first operating element having one or more associated operating elements adapted for altering the first operating parameter, the second operating element having one or more associated operating elements adapted for altering the second operating parameter, the lighting elements of the one or more associated operating elements controllable to be energized and/or de-energized so that only the operating elements associated with selecting and altering a particular one of the first and second operating parameter are made visible on the top surface of the translucent plate while a user is in the process of selecting or otherwise altering the particular one of the first and second operating parameter.

3. A cooking appliance according to claim 2, wherein the lighting elements of the first and second operating elements are configured to be energized upon a user acting on the on-off element to switch the cooking appliance from an "off" status to an "on" status.

4. A cooking appliance according to claim 3, wherein the lighting elements of the one or more operating elements associated with the first operating element are adapted to be energized upon the user acting on the first operating element and the lighting element of the second operating element is adapted to be de-energized upon the user acting on the first operating element.

5. A cooking appliance according to claim 3, wherein the lighting elements of the one or more operating elements associated with the first operating element are adapted to be energized upon the user acting on the first operating element and the lighting element of the second operating element is adapted to be temporarily de-energized upon the user acting on the first operating element.

6. A cooking appliance according to claim 4, wherein the lighting element of the second operating element is adapted to be re-energized at a predetermined amount of time after the first operating element has been acted on.

7. A cooking appliance according to claim 4, wherein the lighting elements of the one or more operating elements associated with the first operating element are adapted to be de-energized at a time after the first operating element has been acted on.

8. A cooking appliance according to claim 2, wherein at least one of the first and second operating elements is useable to select a power setting for the hotplate.

9. A cooking appliance according to claim 2, wherein at least one of the first and second operating elements is useable to select a timer setting for the hotplate.

10. A cooking appliance according to claim 2, wherein the first operating element is useable to select a power setting for the hotplate and the second operating element is useable to select a timer setting for the hotplate.

11. A cooking appliance according to claim 2, wherein the one or more associated operating elements of the first operating element comprises an incrementing control switch and a decrementing control switch, the incrementing and decrementing control switches useable to select a power setting for the hotplate.

12. A cooking appliance according to claim 2, wherein the one or more associated operating elements are useable to select a power setting for the hotplate.

* * * * *